US010508398B2

(12) United States Patent
Prasad et al.

(10) Patent No.: US 10,508,398 B2
(45) Date of Patent: Dec. 17, 2019

(54) INSTALLATION GUIDE WITH QUICK RELEASE AND A METHOD THEREOF

(71) Applicants: Jitendra Prasad, Houston, TX (US); William Hu, Katy, TX (US); Manoj Menon, Katy, TX (US)

(72) Inventors: Jitendra Prasad, Houston, TX (US); William Hu, Houston, TX (US); Manoj Menon, Katy, TX (US); Vishalanand Ghosh, Houston, TX (US); Ramakrishnan H. Prasad, Katy, TX (US)

(73) Assignees: Jitendra Prasad, Houston, TX (US); William C. Hugh, Katy, TX (US); Manoj Menon, Katy, TX (US)

( * ) Notice: Subject to any disclaimer, the term of this patent is extended or adjusted under 35 U.S.C. 154(b) by 0 days.

(21) Appl. No.: 15/966,254

(22) Filed: Apr. 30, 2018

(65) Prior Publication Data

US 2019/0330816 A1 Oct. 31, 2019

(51) Int. Cl.
*E02B 17/00* (2006.01)

(52) U.S. Cl.
CPC ..... *E02B 17/00* (2013.01); *E02B 2017/0039* (2013.01)

(58) Field of Classification Search
CPC . Y10T 403/59; Y10T 403/591; Y10T 403/60; Y10T 403/608; E21B 23/00; E21B 23/01; E21B 23/02; E02B 17/00; E02B 2017/0039; E02B 2017/0043; E02B 2017/0073; E02B 2017/0091
USPC ..... 405/223.1, 224, 224.2, 227; 166/338, 166/340
See application file for complete search history.

(56) References Cited

U.S. PATENT DOCUMENTS 3,163,228 A * 12/1964 Hayes ..... E21B 41/10 166/214
3,716,100 A * 2/1973 Nelson ..... E21B 43/0135 166/343
3,721,294 A * 3/1973 Nelson ..... E21B 43/0135 166/342
4,086,776 A * 5/1978 Beard ..... E21B 41/04 114/258
4,161,367 A * 7/1979 Cuiper ..... E21B 43/0135 405/169
4,258,888 A * 3/1981 Sawn ..... B64F 1/12 114/261

(Continued)

FOREIGN PATENT DOCUMENTS

WO WO-9000491 A1 * 1/1990 ..... B63B 21/502

*Primary Examiner* — Frederick L Lagman
(74) *Attorney, Agent, or Firm* — Hill Wallack LLP; Jason DeFrancesco

(57) ABSTRACT

An installation guide with quick release for installation of a piece of equipment, comprises a base member adapted to be fixed at a predetermined location, the base member having a cavity, an engagement member adapted to be received into the cavity of the base member, a latching mechanism adapted to latch the engagement member with the base member, the latching mechanism including a release line attached with the engagement member and a guide line attached with the engagement member. Further, the latching mechanism is adapted to release the engagement member from the base member on actuation of the release line.

4 Claims, 3 Drawing Sheets

(56) References Cited

U.S. PATENT DOCUMENTS

| | | | | | |
|---|---|---|---|---|---|
| 4,298,218 | A * | 11/1981 | Britch | B63B 21/502 | 285/24 |
| 4,400,112 | A * | 8/1983 | Castel | E21B 41/10 | 166/340 |
| 4,405,261 | A * | 9/1983 | Lawson | B63B 21/502 | 166/366 |
| 4,459,931 | A * | 7/1984 | Glidden | E21B 41/10 | 114/230.1 |
| 4,523,878 | A * | 6/1985 | Richart | E21B 41/10 | 166/340 |
| 4,611,661 | A * | 9/1986 | Hed | E21B 33/035 | 166/339 |
| 4,799,816 | A * | 1/1989 | Lechon | B63B 21/502 | 166/342 |
| 4,854,777 | A * | 8/1989 | Lemoine | B63B 21/502 | 405/202 |
| 5,107,930 | A * | 4/1992 | Hopper | E21B 41/10 | 166/342 |
| 5,163,783 | A * | 11/1992 | Fahrmeier | E21B 43/017 | 166/338 |
| 5,246,075 | A * | 9/1993 | Caulfield | E21B 41/10 | 166/339 |
| 2016/0047107 | A1* | 2/2016 | Shin | E02D 27/425 | 405/227 |

* cited by examiner

INSTALLATION GUIDE WITH QUICK RELEASE AND A METHOD THEREOF

FIELD OF THE INVENTION

The present invention generally relates to installation of structures and equipment that are affected by wind or current induced motions. More specifically the present invention relates to an installation guide with quick release and a method thereof.

BACKGROUND ART

Installation of offshore structures or subsea equipment is not easy because wind, waves or current can cause the structures or equipment to swing or to drift away from the intended precise fixed installation point. This problem is amplified with increase of distance (e.g., height, water depth, etc.) to the fixed installation point. There have been a number of solutions suggested in this regard, but most of such solutions involve use of complex equipment and support systems for initial deployment and redeployment.

The present invention seeks to provide an installation guide with quick release and a method there of that will overcome or substantially ameliorate at least some of the deficiencies of the prior art, or at least provide an alternative.

Any discussion of the background art throughout the specification should in no way be considered as an admission that such background art is prior art nor that such background art is widely known or forms part of the common general knowledge in the field.

SUMMARY OF THE INVENTION

It is therefore an object of the present invention to provide an installation guide with quick release and a method thereof that offer convenient and economical deployment and redeployment without a need for complex equipment and support systems.

The present invention meets the object by providing an installation guide with quick release for installation of a piece of equipment, comprising a base member adapted to be fixed at a predetermined location, the base member having a cavity, an engagement member adapted to be received into the cavity of the base member, a latching mechanism adapted to latch the engagement member with the base member, the latching mechanism including a release line attached with the engagement member, and a guide line attached with the engagement member. Further, the latching mechanism is adapted to release the engagement member from the base member on actuation of the release line.

In one embodiment of the invention, the latching mechanism is constituted by a stopper groove provided along an internal surface of the cavity and one or more latch pins provided with the engagement member, the one or more latch pins being adapted to be received in the stopper groove for latching the engagement member with the base member and adapted to be removed from the stopper groove when actuated by the release line.

In one embodiment of the invention, the one or more latch pins are spring loaded.

In one embodiment of the invention, the one or more latch pins are connected to the release line, through the one or more respective individual cords connecting the one or more respective latch pins with the release line.

In one embodiment of the invention, the release line is adapted to be actuated by one or more of an electrical, a hydraulic, a pneumatic and a mechanical actuation means.

In one embodiment of the invention, the base member is hollow cylindrical in shape.

In one embodiment of the invention, the engagement member includes an engagement cone.

According to another aspect of the present invention, there is provided a method for installation of a piece of equipment, comprising steps of fixing a base member at a predetermined location, the base member having a cavity, passing an engagement member through a hole in the piece of equipment, the engagement member having a guide line attached with the engagement member, receiving the engagement member into the cavity of the base member, wherein a releasable latching mechanism latches the engagement member with the base member, the latching mechanism including a release line attached with the engagement member, guiding the piece of equipment along the guide line, to the predetermined location and actuating the release line to release the engagement member from the base member.

In one embodiment of the invention, during receiving the engagement member into the cavity of the base member, one or more latch pins provided with the engagement member are received in a stopper groove provided along an internal surface of the cavity, for latching the engagement member with the base member.

BRIEF DESCRIPTION OF THE DRAWINGS

At least one example of the invention will be described with reference to the accompanying drawings, in which.

It should be noted that the same numeral represents the same or similar elements throughout the drawings.

DETAILED DESCRIPTION OF THE EMBODIMENTS

Throughout this specification, unless the context requires otherwise, the words "comprise", "comprises" and "comprising" will be understood to imply the inclusion of a stated step or element or group of steps or elements but not the exclusion of any other step or element or group of steps or elements.

Any one of the terms: "including" or "which includes" or "that includes" as used herein is also an open term that also means including at least the elements/features that follow the term, but not excluding others.

In order to install a piece of equipment or an offshore structure to a predetermined location, while negating any effects of wind, waves and current, a base member may be installed at the predetermined location, such as at an above surface or a subsea location. An engagement member passing through a hole in the piece of equipment or the offshore structure can be made to engage with the base member, where a latching mechanism latches the engagement member with the base member. The piece of equipment may then be guided to the predetermined location along a guide line attached with the engagement member. After installation, the engagement member may be released from the base member, by actuating a release line that causes the latching mechanism to release the engagement member.

Figure 1:
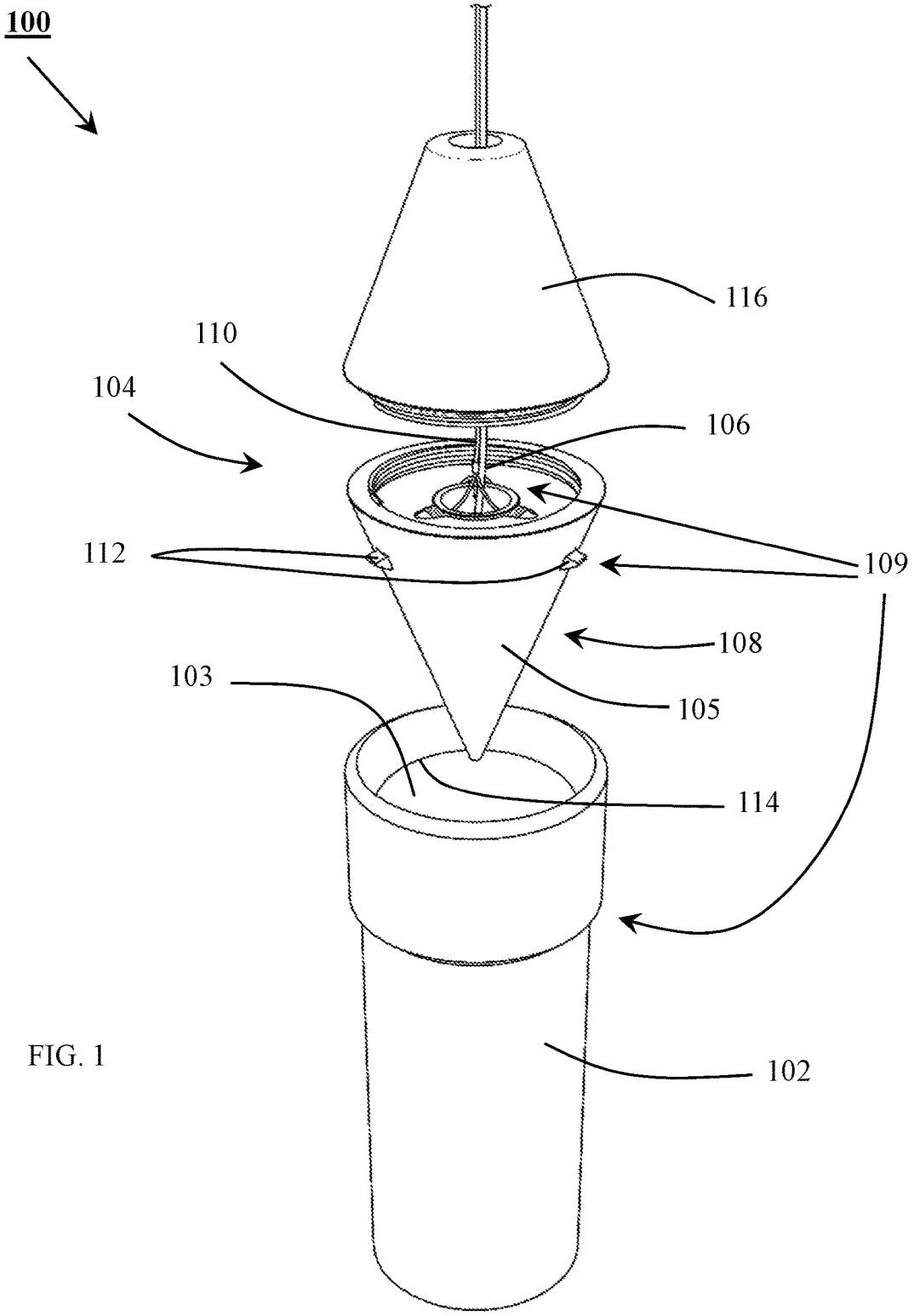
FIG. 1 illustrates an exploded view of an installation guide with quick release for installation of a piece of equipment, in accordance with an embodiment of the present invention.

FIG. 1 illustrates an exploded view of a marine installation device 100 (hereinafter referred to as "the device 100") for installation of a piece of equipment or structure, in accordance with an embodiment of the present invention. The device 100 comprises a base member 102 adapted to be fixed at a predetermined location. The base member 102 is contemplated to have a cavity 103. The base member 102 may be made of corrosion resistant metal, metal alloy, other material or combination/composite of multiple materials. All exposed surfaces of the base member 102 may be coated to prevent long term corrosion and/or abrasion. In this embodiment of the invention, the base member 102 has a cylindrical shape. However, the shapes and dimensions of the base member 102 may vary in accordance with the requirement for installation of the structure or the piece of equipment without department from the scope of the invention Further, the device 100 includes a guide member 104 that is attached with a guide line 106 and a release line 110. The guide member 104 may be made of corrosion resistant metal, metal alloy, other material or a combination/composite of multiple materials. The exposed surfaces of guide member 104 may be coated to prevent long term corrosion, abrasion or erosion. The guide line 106 may be made of metallic, synthetic or natural fibres or combination of multiple types of fibres. An engagement member 108 makes up a lower part of the guide member 104 and is adapted to be received into a cavity 103 of the base member 102.

It is envisaged here that size and shape of the engagement member 108 may be suited to match those of the base member 102 in order to have a secured coupling. For example, in one embodiment of the invention, the engagement member 108 includes an engagement cone 105 adapted to be received into the cavity 103 of the base member 102. The engagement cone 105 may also be made of corrosion resistant metal, metal alloy, other material or combination/composite of multiple materials. The engagement cone 105 may be coated to prevent long term corrosion and/or abrasion.

In that manner, top of the base member 102 may be flared to facilitate the insertion of the engagement member 108 (and the engagement cone 105). In various other embodiments, each of the base member 102 and the engagement member 108 may have polygonal cross sections, with at least one lateral side of each having a draft for easy insertion and removal of the engagement member 108 into and out of the cavity 103. The guide member 104 also includes a cover 116 provided with the engagement member 108, that prevents entry of any foreign agents such as water, debris, dust, organic matters and other extraneous matter etc. into the engagement member 108. The connection between cover 116 and engagement member 108 may include a washer, gasket, or sealant as required by operating conditions. The guide line 106 is envisaged here to be compliant and flexible and easy to be wrapped around a spool. In that manner, the guide line 106 may be made up of a ductile metal, woven polymeric material. Many other materials (such as metal composites, natural fibres or combination/composites of multiple materials) for the guide line 106 are applicable, without departing from the scope of the invention. The guide line 106 may also be coated to prevent corrosion and/or abrasion.

Further, the device 100 includes a latching mechanism 109 adapted to latch the engagement member 108 with the base member 102. The latching mechanism 109 is envisaged to include the release line 110. The release line 110 is also envisaged here to be compliant and flexible and easy to be wrapped around a spool. In that manner, the release line 110 may be made up of a ductile metal or woven polymeric material. Many other materials (such as metal composites, natural fibre or combination/composites of multiple materials) for the release line 110 are applicable, without departing from the scope of the invention. The latching mechanism 109 is adapted to release the engagement member 108 from the base member 102 on actuation of the release line 110. It is envisaged here, that on remote pulling or tensioning of the release line 110, the latching mechanism 109 causes the engagement member 108 to be released from the base member 102. In other words, the latching mechanism 109 is envisaged to temporarily latch the engagement member 108 with the base member 102. The release line 110 may be adapted to be actuated by any one or more of an electrical, a hydraulic, a pneumatic and a mechanical actuation means (such as motors and linear actuators). This can be understood in detail from the following discussion of the embodiments discussed below.

In one embodiment of the invention, the latching mechanism 109 is constituted by a stopper groove 114 provided along an internal surface of the cavity 103 and one or more latch pins 112 provided with the engagement member 108. It can be seen from FIG. 1, that the one or more latch pins 112 are adapted to be projecting out from an external surface of the engagement member 108 (or more precisely the engagement cone 105). The one or more latch pins 112 are also adapted to be received in the stopper groove 114 for latching the engagement member 108 with the base member 102. Moreover, the one or more latch pins 112 are adapted to be removed from the stopper groove 114 when actuated by the release line 110. This can be understood from the following figure.

Figure 2:
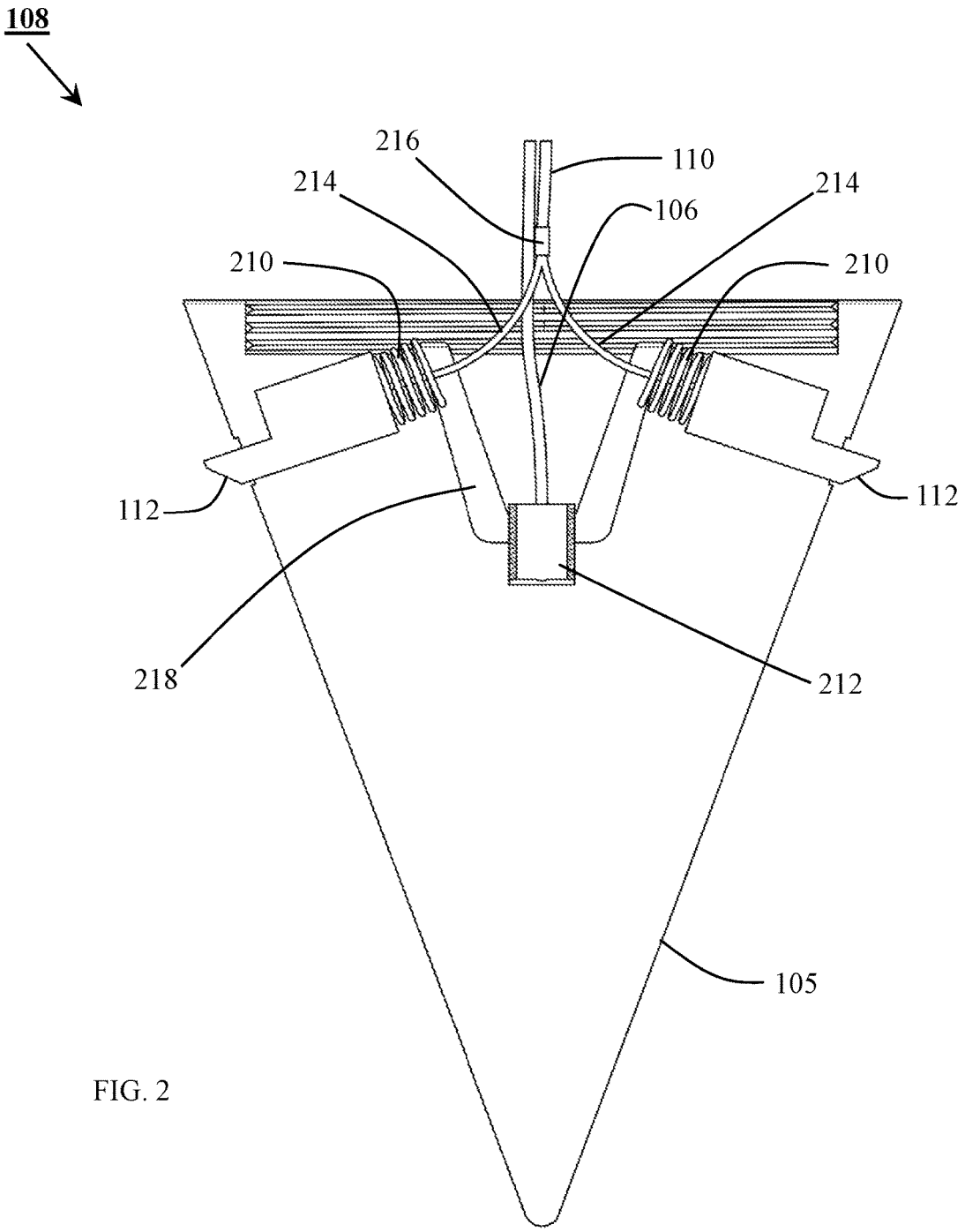
FIG. 2 illustrates a sectional view of an engagement member of the installation guide with quick release, in accordance with an embodiment of the present invention.

FIG. 2 illustrates a sectional view of the engagement member 108, in accordance with an embodiment of the present invention. As can be seen from FIG. 2, the guide line 106 may be attached with the engagement member 108 through a screw-on plug 212. The guide line 106 may be secured to the screw-on plug 212 by a knot or a bonding agent. The one or more latch pins 112 are spring loaded using one or more respective latch springs 210, such that the one or more latch pins 112 are pushed to protrude from the engagement member 108 by the one or more respective latch springs 210. At contact points between each latch pin 112 and the engagement member 108, a lubricating coating or lining may or may not be applied to reduce friction and to facilitate free movement depending on application.

The latch pins 112 are made of metal, metal alloy, other material or combination/composite of multiple materials. And, the latch pins 112 may be coated to protect from corrosion and/or abrasion and to reduce friction. In this embodiment of the invention, the latch pins 112 are of cylindrical shape with a protrusion. However, the latch pins 112 may be of any other shape or dimensions without departing from the scope of the invention The latch springs 210 are made of metal or metal alloy material and may be coated or sleeved to protect from corrosion and to reduce friction. In this embodiment of the invention, the latch spring 210 is coil shaped. However, the latch springs may be of any shape without departing from the scope of the invention.

The one or more latch pins 112 are connected to the release line 110, through the one or more respective individual cords 214 connecting the one or more respective latch pins 112 with the release line 110. Much like the release line 110, the one or more individual cords 214 are also envisaged here to be compliant and flexible and easy to be wrapped around a spool. In that manner, the one or more individual cords 214 may be made up of a ductile metal, natural fibre, woven polymeric material or a combination of multiple types of fibres. The one or more individual cords 214 are connected to the release line 110 through a line joint 216. The line joint 216 may be a metal clamp or a bonding agent to secure the one or more individual cords 214 with the release line 110. In an alternate embodiment of the invention, the one or more individual cords 214 may be splits of the release line 110. The one or more latching pins 112 and the one or more latch springs 210 are held in position by a latch stopper 218 that is screwed into the engagement member 108.

When the engagement member 108 is inserted into the cavity 103, the one or more latch pins 112 are received in the stopper groove 114. More specifically, after the engagement member 108 is inserted into the cavity 103 of the base member 102, the one or more latch pins 112 are pushed out by the respective one or more latch springs 210 to project out from an external surface of the engagement cone 105, below the stopper groove 114. The one or more latch pins 112 are held by the stopper groove 114, which in turn latches the engagement member 108, and hence the guide member 104, to the base member 102. The one or more latch springs 210 act as retainers to retain the one or more latch pins 112 inside the stopper groove 114.

However, on tensioning or actuation of the release line 110, which in turn pulls on the one or more individual cords 214, the one or more latch pins 112 are retracted towards the engagement member 108 and out from the stopper groove 114. This in turn allows the engagement member 108 to be retracted out of the base member 102. It is to be noted here that there can be many more variations to the latching mechanism 109 that are not shown in the FIGS. 1 and 2, without departing from the scope of the invention. One such alternative implementation of the latching mechanism 109 has been discussed in the following discussion.

In yet another embodiment, the latching mechanism 109 may be constituted by one or more clamps provided with the engagement member 108. The one or more clamps may be adapted to be clamped onto the base member 102 for latching the engagement member 108 with the base member 102. In such a scenario, the base member 102 may also comprise a stopper projection projecting out from an external surface of the base member 102, such that, the one or more clamps may be adapted to be clamped onto the stopper projection. Also, the one or more clamps would be adapted to release the base member 102 when actuated by the release line 110. Here again, in one embodiment, the one or more clamps may be spring loaded. Where, one or more respective clamping springs would keep the one or more clamps clamped onto the base member 102. The tensioning of the release line 110 would then cause the one or more clamps to release the base member 102 allowing the engagement member 108 to be retracted.

Figure 3:
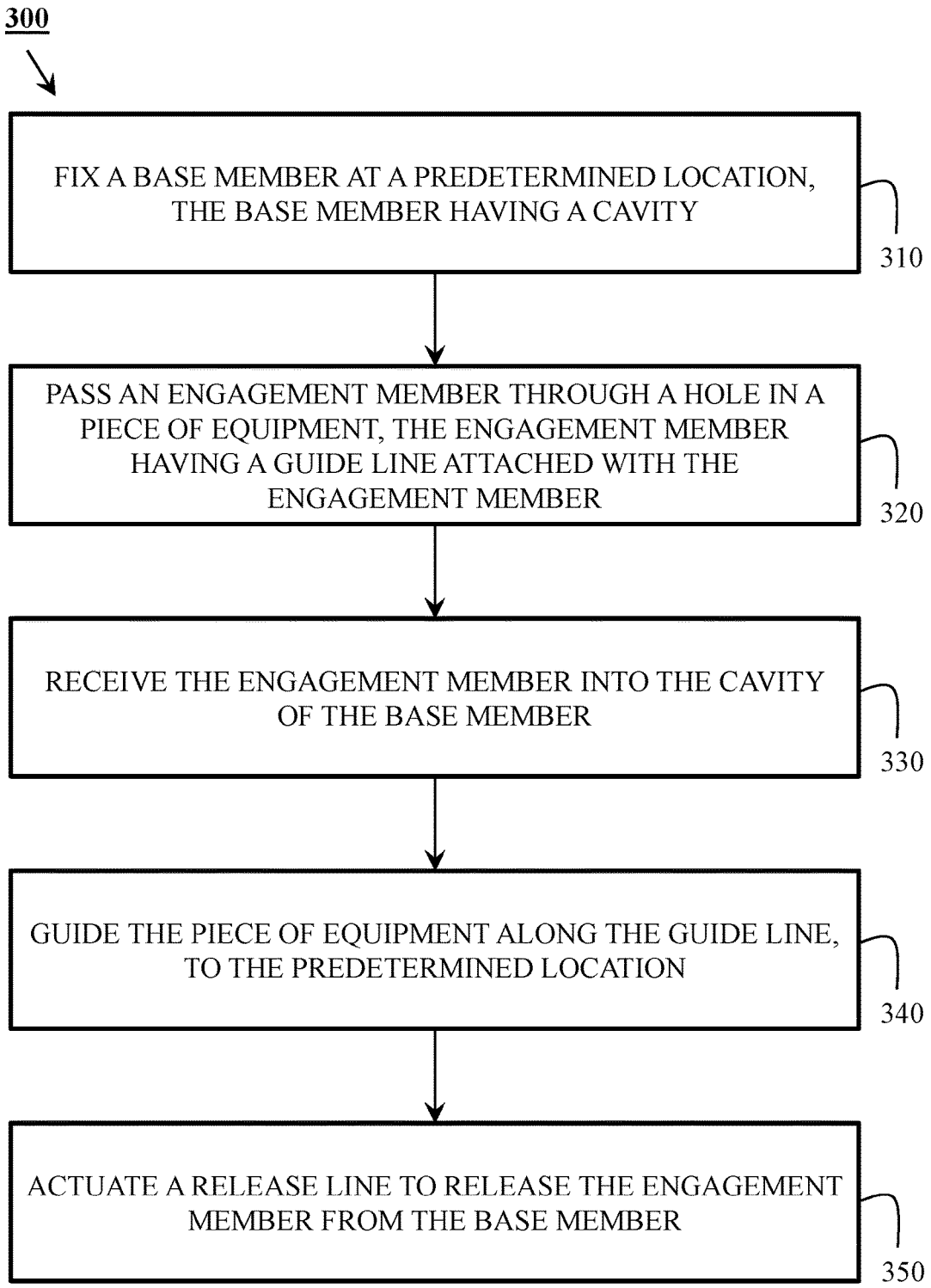
FIG. 3 illustrates a method for installation of a piece of equipment, in accordance with an embodiment of the present invention.

FIG. 3 illustrates a method 300 for installation of a piece of equipment, in accordance with an embodiment of the present invention. The method begins at step 310, when the base member 102 is fixed at the predetermined location. The predetermined location may be above surface or subsea location.

At step 320, the guide member 104 is passed through a hole in the piece of equipment. As a consequence, the engagement member 108 too passes through the hole in the piece of the equipment. As discussed above, the guide line 106 and the release line 110 are attached with the guide member 104, and in turn the engagement member 108.

At step 330, the engagement member 108 portion of the guide member 104 is received into the cavity 103 of the base member 102. Above water surface, a person or a remotely guided mechanical arm can install the engagement member 108 into the base member 102. In shallow water, a diver can guide and insert the engagement member 108 into the base member 102. In deeper water, a Remotely Operated Vehicle (ROV) guides and inserts the engagement member 108 into the base member 102. The latching mechanism 109 latches the engagement member 108 with the base member 102. As discussed above, the latching mechanism 109 includes the release line 110.

In one embodiment of the invention, during receiving the engagement member 108 into the cavity 103 of the base member 102, the one or more latch pins 112 provided with the engagement member 108 are received in the stopper groove 114 provided along the internal surface of the cavity 103. As a consequence, the one or more latching pins 112 latch the engagement member 108 with the base member 102. In another embodiment, during receiving the engagement member 108 into the cavity 103 of the base member 102, the one or more clamps provided with the engagement member 108 are clamped onto the base member 102 for latching the engagement member 108 with the base member 102.

At step 340, the piece of equipment is guided along the guide line 106, to the predetermined location. The piece of equipment may then be installed at the predetermined location accordingly.

At step 350, the release line 110 is actuated to release the engagement member 108, and hence the guide member 104, from the base member 102. The release line 110 may be actuated by one or more of an electrical, a hydraulic, a pneumatic and a mechanical actuation means. The actuation of the release line 110, may for example cause retraction of the one or more guide pins 112 or the one or more clamps, depending upon the specific implementation.

The present invention offers convenient and economical device and method for installations of offshore equipment and structures whether above surface or subsea. The invention is easier to implement and does not require use of complex equipment and support systems. Further, this invention has most applications in offshore and subsea installation of structures or equipment, however this invention can be applied to land-based installations without departing from the scope of the present invention The terms and descriptions used herein are set forth by way of illustration only and are not meant as limitations. Examples and limitations disclosed herein are intended to be not limiting in any manner, and modifications may be made without departing from the spirit of the present disclosure. Those skilled in the art will recognize that many variations are possible within the spirit and scope of the disclosure, and their equivalents, in which all terms are to be understood in their broadest possible sense unless otherwise indicated.

Various modifications to these embodiments are apparent to those skilled in the art from the description and the accompanying drawings. The principles associated with the various embodiments described herein may be applied to other embodiments. Therefore, the description is not intended to be limited to the embodiments shown along with the accompanying drawings but is to be providing broadest scope of consistent with the principles and the novel and inventive features disclosed or suggested herein. Accordingly, the disclosure is anticipated to hold on to all other such alternatives, modifications, and variations that fall within the scope of the present disclosure and appended claims.

The invention claimed is:

1. An installation guide with quick release for installation of a piece of equipment, the installation guide with quick release comprising:

a base member adapted to be fixed at a predetermined location, the base member having a cavity;

an engagement member adapted to be received into the cavity of the base member;

a latching mechanism adapted to latch the engagement member with the base member, the latching mechanism including a release line attached with the engagement member; and a guide line attached with the engagement member;

wherein the latching mechanism is adapted to release the engagement member from the base member on actuation of the release line;

wherein the engagement member includes an engagement cone;

wherein the latching mechanism is constituted by a stopper groove provided along an internal surface of the cavity and one or more latch pins provided with the engagement member, the one or more latch pins being adapted to be received in the stopper groove for latching the engagement member with the base member and adapted to be removed from the stopper groove when actuated by the release line; and wherein the one or more latch pins are connected to the release line, through the one or more respective individual cords connecting the one or more respective latch pins with the release line.

2. The installation guide with quick release as claimed in claim 1, wherein the one or more latch pins are spring loaded.

3. The installation guide with quick release as claimed in claim 1, wherein the release line is adapted to be actuated by one or more of an electrical, a hydraulic, a pneumatic and a mechanical actuation means.

4. The installation guide with quick release as claimed in claim 1, wherein the base member is hollow cylindrical in shape.

* * * * *